US006062675A

United States Patent [19]

Hirosawa et al.

[11] Patent Number: 6,062,675

[45] Date of Patent: May 16, 2000

[54] RECORDING HEAD, RECORDING APPARATUS AND MANUFACTURING METHOD OF RECORDING HEAD

[75] Inventors: Toshiaki Hirosawa, Hiratsuka; Toru Yamane, Yokohama, both of Japan

[73] Assignee: Canon Kabushiki Kaisha, Tokyo, Japan

[21] Appl. No.: 08/777,173

[22] Filed: Dec. 27, 1996

[30] Foreign Application Priority Data

Jan. 9, 1996 [JP] Japan ..... 8-001078

[51] Int. Cl.[7] ..... B41J 2/14

[52] U.S. Cl. ..... 347/50; 347/67

[58] Field of Search ..... 347/205, 57, 58, 347/59, 50

[56] References Cited

U.S. PATENT DOCUMENTS

| | | | |
|---|---|---|---|
| 5,103,246 | 4/1992 | Dunn | 347/58 |
| 5,164,747 | 11/1992 | Osada et al. | 346/140 R |
| 5,197,892 | 3/1993 | Yoshizawa et al. | 347/50 |
| 5,220,345 | 6/1993 | Hirosawa | 346/1.1 |
| 5,343,227 | 8/1994 | Hirosawa et al. | 349/42 |
| 5,420,623 | 5/1995 | Tamura | 347/58 |

FOREIGN PATENT DOCUMENTS

| | | |
|---|---|---|
| 0352142 | 1/1990 | European Pat. Off. . |
| 0636480 | 1/1995 | European Pat. Off. . |
| 2-22064 | 7/1988 | Japan . |
| 1-302829 | 12/1989 | Japan . |
| 3-121851 | 5/1991 | Japan . |
| 5-138887 | 6/1993 | Japan . |

*Primary Examiner*—John Barlow
*Assistant Examiner*—Charles W. Stewart, Jr.
*Attorney, Agent, or Firm*—Fitzpatrick, Cella, Harper & Scinto

[57] ABSTRACT

A recording head for recording on a recording medium, comprises a recording element substrate provided with a plurality of recording elements for recording on the recording medium based on a signal, and a plurality of wiring electrodes electrically connecting to the recording elements respectively, and a driving element substrate provided with a plurality of driving elements for selectively driving the recording elements, and connecting wiring electrodes for sending the signal output from the each driving element to the wiring electrodes on the recording element substrate, upon being connected to wirings of the recording element substrate, wherein the positioning between the recording element substrate and the driving element substrate is made by abutting the recording element substrate against the end face of the driving elements.

20 Claims, 12 Drawing Sheets

RECORDING HEAD, RECORDING APPARATUS AND MANUFACTURING METHOD OF RECORDING HEAD

BACKGROUND OF THE INVENTION

Field of the Invention

The present invention relates to a recording head having a recording element substrate having recording elements for use in recording on a recording medium and a driving element substrate with driving elements for driving said recording elements in accordance with an electrical signal entered from the outside, a recording apparatus provided with said recording head, and a manufacturing method thereof.

A recording element unit (recording unit) for use in an ink-jet recording apparatus is well known, for example, such as that shown in FIG. 1. In FIG. 1, a recording element substrate 101 formed with a plurality of recording elements for recording on a recording medium is joined together with a driving element substrate 106 formed with driving elements 107 for driving the recording elements based on an electrical signal from the outside. Also, a portion of the recording element substrate where the recording elements are formed is secured with a ceiling plate formed with a liquid chamber for temporarily storing the ink supplied externally and grooves for constituting the ink flow passages and the ink discharge orifices corresponding to the recording elements. The recording element substrate 101 and the driving element substrate 106 will be described below in succession.

FIGS. 2A and 2B are plan views of the recording element substrate as shown in FIG. 1, and a cross-sectional view thereof taken along the line 2B—2B. As shown in FIGS. 2A and 2B, the recording element substrate 101 has formed thereon an $HfB_2$ layer 104 which is a heating resistive layer. The $HfB_2$ layer 104 is connected via pattern wirings 105*a*, 105*b* to a common wiring electrode 102*b* made of aluminum and a plurality of individual wiring electrodes 102*a* made of aluminum arranged in one row at the end of the recording element substrate 101. On each pattern wiring 105*a*, 105*b* and the $HfB_2$ layer 104, an $SiO_2$ layer 111 for anti-oxidation and insulation is formed. Further, a Ta layer 112 for anti-cavitation is formed on a portion of the $SiO_2$ layer 111 over the $HfB_2$ layer 104, and a photosensitive polyimide layer 113 for ink proof and insulation is formed on the other portion.

FIG. 3 is a plan view of the driving element substrate as shown in FIG. 1. As shown in FIG. 3, the driving element substrate 106 is formed with a plurality of connecting wiring electrodes 109*a* corresponding to discrete electrodes 102*a* of the recording element substrate 101 respectively, and two connecting wiring electrodes 109*b* corresponding to a common wiring electrode 102*b* of the recording element substrate 101. These connecting wiring electrodes 109*a*, 109*b* are arranged in one row and connected to the driving elements 107 respectively. And by joining this driving element substrate 106 with the recording element substrate 101 as shown in FIG. 1, the wiring electrodes 102*a* are individually connected to the connecting wiring electrodes 109*a*, and the common wiring electrode 102*b* is connected to the connecting wiring electrodes 109*b*.

On the basis of the above-described constitution, if a driving signal from the driving elements 107 is applied via connecting electrodes 109*a* to the recording element substrate 101, a current will flow through the $HfB_2$ layer 104, thereby generating heat energy in the $HfB_2$ layer 104. By the use of this heat energy, the recording can be made on the recording medium. For example, in a thermal head, which is provided with no ceiling plate 153 as shown in FIG. 1, this heat is directly used for the coloring on the thermosensitive paper, or fuse the ink of an ink ribbon for transfer onto the recording medium. Also, in an ink-jet head, a ceiling plate 153 is further secured onto the recording element substrate 101 to form the ink flow passages, as shown in FIG. 1, whereby the recording can take place by discharging the ink within the ink flow passages by means of the heat energy produced in the $HfB_2$ layer 104.

Normally, a plurality of heating elements (recording elements) composed of a combination of the $HfB_2$ layer 104, discrete electrodes 102*a* and pattern wirings 105*a*, 105*b* are formed on one recording element substrate 101, as shown in FIG. 2A. Thereby, a recording apparatus for recording plural dots can be obtained, with higher speed of the recording attained. In particular, as the recording of higher density and at higher speed is greatly demanded nowadays, it is common practice that the recording for one main scan line is made at the same time, and accordingly, a recording element unit having arranged a number of heating elements at high density has appeared.

In recording plural dots at the same time by means of a plurality of heating elements arranged on one recording element substrate 101, each of the heating elements must be individually controlled to turn on or off. The driving elements 107 for making such control is normally formed on other substrate than the recording element substrate 101 as above described, with this substrate being connected to the recording element substrate 101, although it can be formed within the recording head substrate 101. This is because where the heating elements and the driving elements 107 are formed on the same substrate, if either the heating elements or the driving elements 107 fail, the other elements will also malfunction.

On the other hand, a technique for securely making the electrical connection between the recording element substrate 191 and the driving element substrate 106 was disclosed in Japanese Laid-open Patent Application No. 3-121851. This technique involves joining the recording element substrate 201 and the driving element substrate (not shown) by pressure welding, with each electrode 202*a*, 202*b* of the recording element substrate 201 being of bump shape, as shown in FIGS. 4A and 4B. Thereby, the recording element substrate 201 and the driving element substrate can be securely joined even if they are warped.

Also, a technique using an electrical connecting member was disclosed in Japanese Laid-open Patent Application No. 1-302829. This technique involves joining a recording element substrate 301 and a driving element substrate 306 by pressure bonding with an electrical connecting member 310 carried at a junction between the recording element substrate 301 and the driving element substrate 306, as shown in FIG. 5. Herein, a plurality of electrodes are formed by disposing insulating membranes 303, 308 at respective predetermined pitches on the electrode portions 302, 307 across the surfaces of the recording element substrate 301 and the driving element substrate 306, respectively, as shown in FIGS. 6A and 6B. The electrical connecting member 310 is composed of electrically conductive members 311 and insulating holding members 312 which are alternately disposed. The pitch of electrical conductive members is narrower than that of electrodes, so that the opposed electrodes of the recording element substrate 301 and those of the driving element substrate 306 are securely connected electrically.

On the other hand, it is required that the electrodes of the recording element substrate and the connecting electrodes of the driving element substrate be positioned at high precision with respect to each other, because of their high density arrangement. For the positioning between the recording element substrate and the driving element substrate, a positioning pin may be provided on a holding member for the recording element substrate or a jig to place the end face of the driving element substrate into abutment with this pin, or at least one of the recording element substrate and the driving element substrate is made of a transparent material to enable minute adjustment of the position between the recording element substrate and the driving element substrate, while confirming the position of electrodes with one's own eyes or by means of optical means such as a TV camera.

FIG. 7 is a perspective view of an ink-jet recording apparatus using a recording element unit as shown in FIG. 1. In FIG. 7, a recording element substrate 101 is fixed to a main base board 151, and a driving element substrate 106 is fixed to a sub-base board 152. The sub-base board 152 is pressed via an elastic member 155 by an application plate 154, thereby allowing the recording element substrate 101 and the driving element substrate 106 to be welded by pressure and electrically connected. The recording element substrate 101 is secured to a ceiling plate 153 having formed grooves (not shown) therein for constituting the ink flow passages corresponding to the positions of an $HfB_2$ layer 104 (see FIGS. 2A and 2B), ink discharge orifices and a common liquid chamber for holding the ink to be supplied to the ink flow passages. The common liquid chamber stores the ink supplied through a filter box 158, an ink supply tube 157 and an ink supply pipe 156 from an ink tank (not shown).

Also, in this ink-jet recording apparatus having the recording element substrate 101 and the driving element substrate 106 which are pressed to each other by the application plate 154, if either of the recording element substrate 101 or the driving element substrate 106 fails, it can be simply replaced.

However, since the wirings and electrodes are arranged at high density as the recording elements are arranged at high density in recent years, it is required that the recording element substrate and the driving element substrate be aligned at high precision. Accordingly, the misregistration which conventionally caused no problem will result in an electrical contact failure in some cases. With the conventional alignment method, it was difficult to attain a sufficient alignment precision corresponding to the high density arrangement of recording elements. In addition, a dedicated jig or tool was required for the alignment between the recording element substrate and the driving element substrate, as previously described.

Thus, an object of the present invention is to provide a recording head which allows the alignment between the recording element substrate and the driving element substrate easily and accurately without the use of any special jig or tool, a recording apparatus using the recording head, and a manufacturing method for the recording head.

To achieve the above-described object, the recording head of the present invention comprises a recording element substrate provided with a plurality of recording elements for recording on a recording medium based on a signal, and a plurality of wiring electrodes electrically connecting to said recording elements respectively, and a driving element substrate provided with a plurality of driving elements for selectively driving said recording elements, and connecting wiring electrodes for sending said signal output from said driving elements to the wiring electrodes on said recording element substrate, upon being connected to wirings of said recording element substrate, wherein the positioning between said recording element substrate and said driving element substrate is made by abutting said recording element substrate against the end face of said driving elements.

Or the recording head of the invention comprises a recording element substrate provided with a plurality of recording elements for recording on a recording medium based on a signal, and a plurality of wiring electrodes electrically connecting to said recording elements respectively, a driving element substrate provided with a plurality of driving elements for selectively driving said recording elements, and connecting wiring electrodes for sending said signal output from said driving elements to the wiring electrodes on said recording element substrate, upon being connected to wirings of said recording element substrate, and a positioning member, mounted on said driving element substrate by flip-chip bonding, for positioning the junction with said recording element substrate, wherein the electrical connection between said recording element substrate and said driving element substrate is made in the state where said recording element substrate is abutted against said positioning member.

Or the recording apparatus of the invention comprises any one of the recording heads as above described, and means for conveying a recording medium to be recorded by a recording head.

The recording head manufacturing method includes the steps of providing a recording element substrate provided with a plurality of recording elements for recording on a recording medium based on a signal, and a plurality of wiring electrodes electrically connecting to said recording elements respectively, providing a plurality of driving elements for selectively driving said recording elements and a positioning member for positioning the junction with said recording element substrate, through a flip-chip bonding process, on a driving element substrate provided with connecting wiring electrodes for sending said signal output from said each driving element to the wiring electrodes on said recording element substrate, upon being connected to wirings of said recording element substrate, wherein the electrical connection between said recording element substrate and said driving element substrate is made in the state where said recording element substrate is abutted against said positioning member.

Of the recording heads of the present invention as above described, a recording head in which the positioning between the recording element substrate and the driving element substrate is made by abutting one end face of the recording element substrate agains the end face of the driving elements can be fabrication at lower costs or with simpler constitution, because there is no need for providing the special positioning member, or the special process of attaching the positioning member. Further, for a recording head in which the positioning member is disposed through the same flip-chip bonding process as that of providing the driving elements on the driving element substrate, there is no need for mounting the positioning member specifically, resulting in simpler process and lower costs, in which the positioning member is provided on the driving element substrate through the same flip-chip bonding process as that of mounting the driving elements on the substrate. Also, the manufacturing method of the head of the present invention allows for the simplification of the process and the reduction of the manufacturing time.

DETAILED DESCRIPTION OF THE PREFERRED EMBODIMENTS

The preferred embodiments of the present invention will be described below with reference to the drawings.

(First embodiment)

Figure 8:
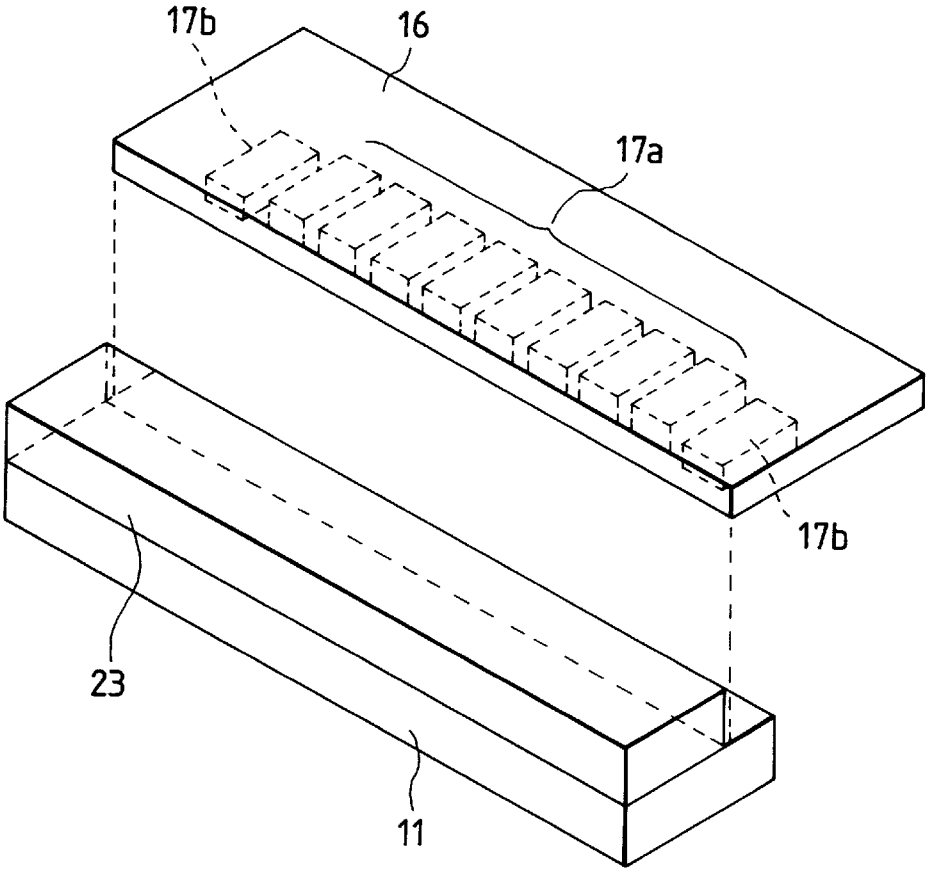
FIG. 8 is an exploded perspective view of a first embodiment of the recording head according to the present invention.

FIG. 8 is an exploded perspective view of a first embodiment of a recording head according to the present invention. Also, FIG. 9 is a side view of the recording head as shown in FIG. 8, FIG. 10 is a view of the recording head seen from bottom as shown in FIG. 8, and FIG. 11 is a view of a driving element substrate seen from bottom as shown in FIG. 8.

Figure 1:
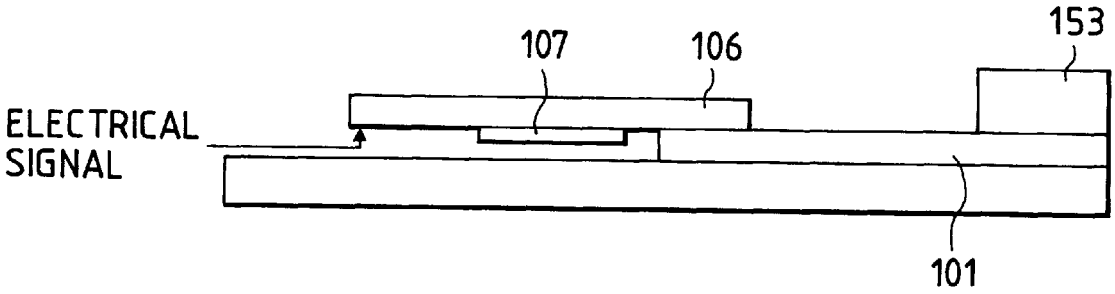
FIG. 1 is a side view of a conventional recording element unit.
Figure 3:
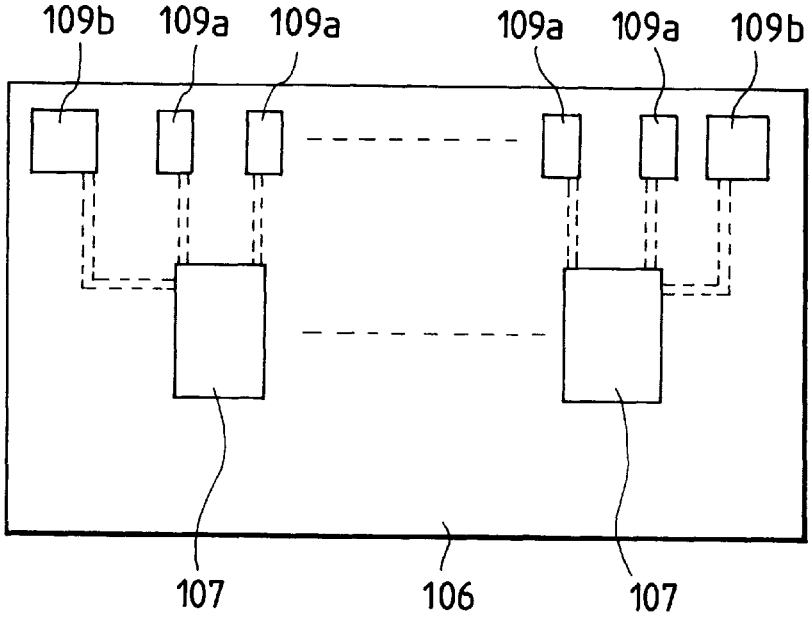
FIG. 3 is a plan view of a driving element substrate as shown in FIG. 1.
Figure 2A:
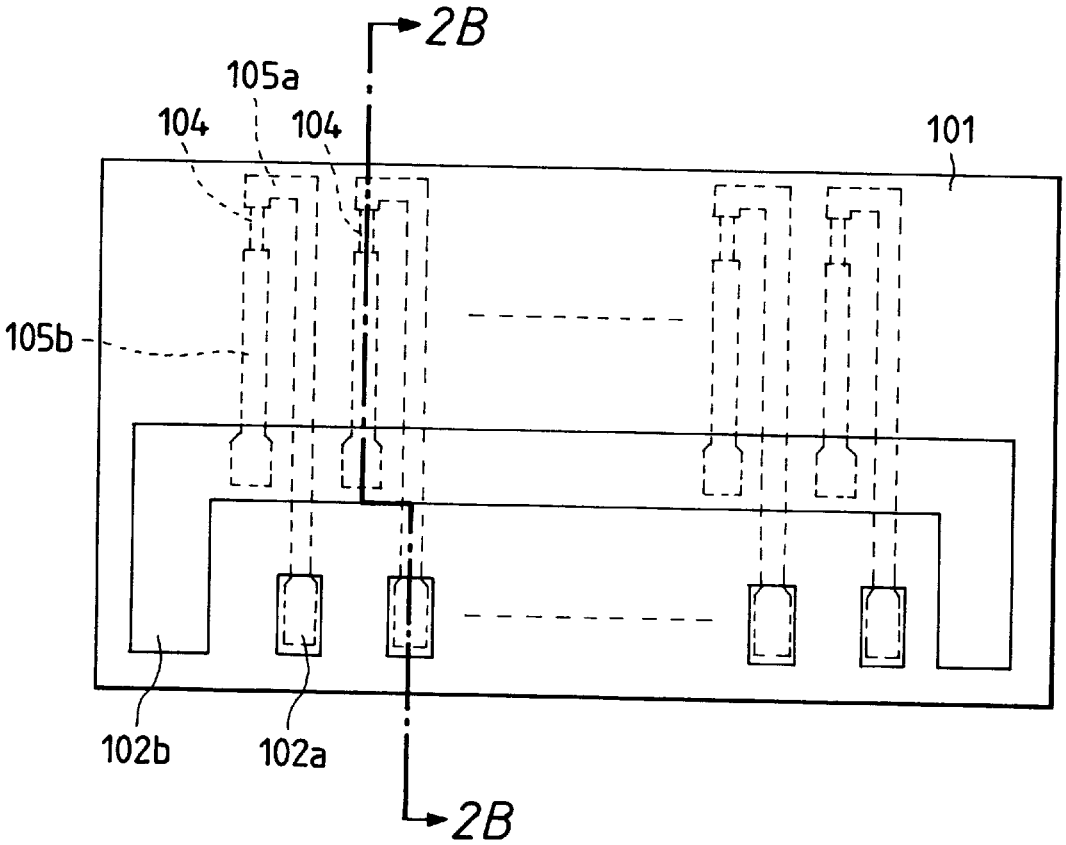
FIGS. 2A and 2B are plan views of a recording element substrate as shown in FIG. 1 and a cross-sectional view taken along the line 2B—2B.
Figure 2B:
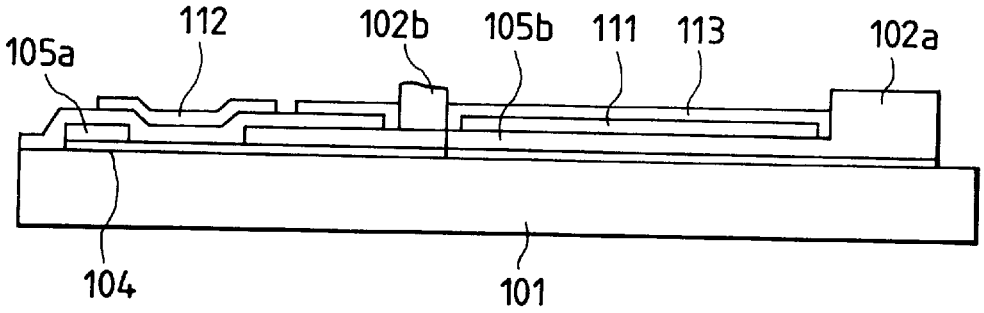
Figure 4A:
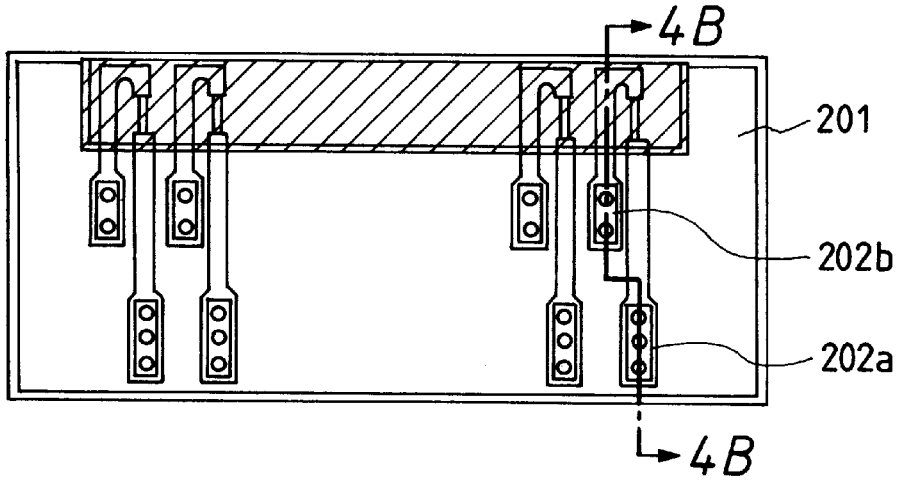
FIG. 4A is a plan view of the recording element substrate and FIG. 4B is a cross-sectional view taken along the line 4B—4B in FIG. 4A, illustrating a technique for securely making the electrical connection between the recording element substrate and the driving element substrate.
Figure 4B:
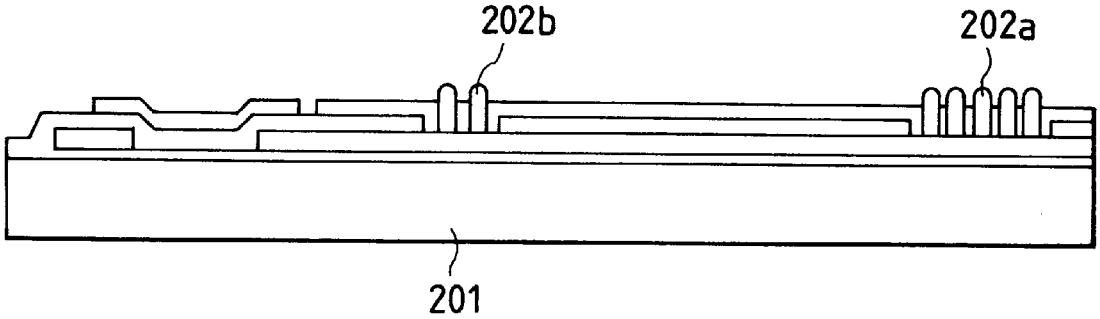
Figure 5:
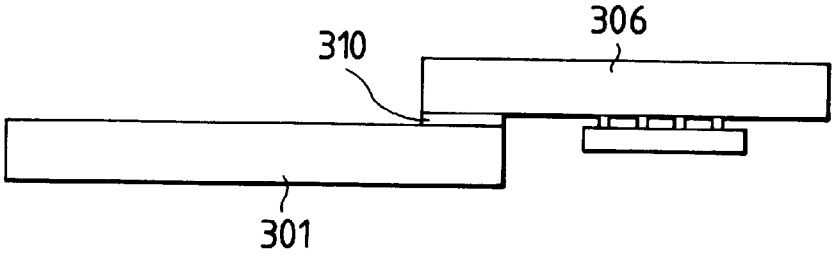
FIG. 5 is a side view of the recording element unit, illustrating another technique for securely making the electrical connection between the recording element substrate and the driving element substrate.
Figure 9:
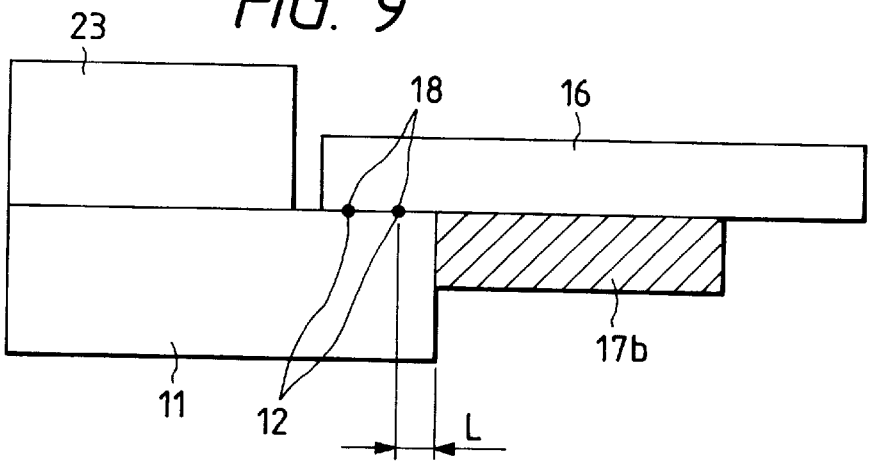
FIG. 9 is a side view of the recording head as shown in FIG. 8.
Figure 10:
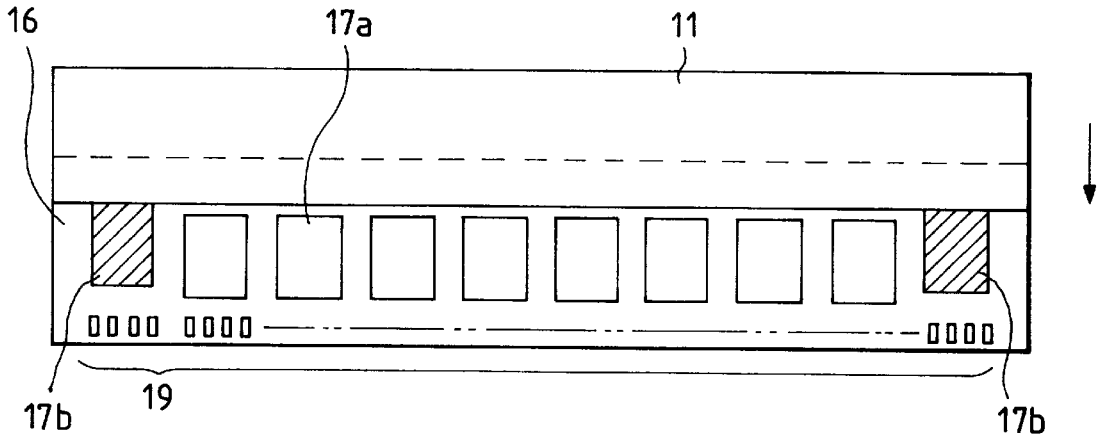
FIG. 10 is a view of the recording head as shown in FIG. 8, as seen from bottom.

In FIGS. 8, 9 and 10, a recording element substrate 11 is the same as the conventional recording element substrate as shown in FIGS. 2A and 2B, and has formed thereon a plurality of heating elements (not shown) as recording elements composed of an $HfB_2$ layer, and a plurality of wiring electrodes 12 connecting to respective heating elements. A ceiling plate is secured onto a portion where the heating elements are formed. This ceiling plate 23 is also the same as conventional one, whereby the ceiling plate is secured onto the recording element substrate 11 to make the ink flow passages and the ink discharge ports corresponding to heating elements respectively. Also, the wiring electrodes 12 of the recording element substrate 11 are formed such that the distance L from the end face of the recording element substrate 11 is within a precision of about ±20 $\mu$m, as shown in FIG. 9.

Figure 11:
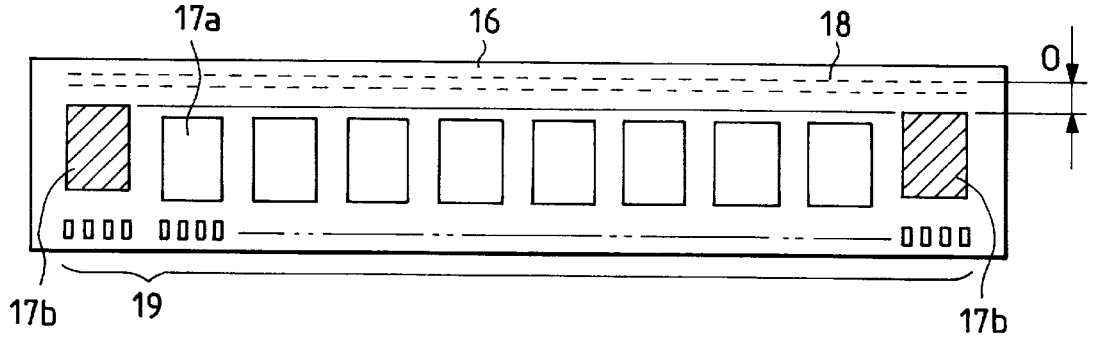
FIG. 11 is a view of the driving element substrate as shown in FIG. 8, as seen from bottom.

On the other hand, a driving element substrate 16 has mounted a plurality of driving elements 17*a*, 17*b* of the IC-chip for selectively driving heating elements, as shown in FIG. 11. The driving elements 17*a*, 17*b* are connected to respective connecting wiring electrodes 18, and when the recording element substrate 11 and the driving element substrate 16 are welded together, as shown in FIGS. 9 and 10, the wiring electrodes 12 of the recording element substrate 11 and the connecting wiring electrodes 18 of the driving element substrate 16 are electrically connected, thereby enabling the control of heating elements by the driving elements 17*a*, 17*b*. An electrical signal to the driving elements 17*a*, 17*b* is input via the external input connecting pads 19 externally of the driving element substrate 16.

Two driving elements 17*b* placed most outwardly among the driving elements are mounted such that the distance O from the end face thereof on the side of the recording element substrate 11 to the connecting wiring electrodes 18 is equal to a predetermined distance. Other driving elements 17*a* are mounted such that the distance from the end face thereof on the side of recording element substrate 11 to the connecting wiring electrodes 18 is greater than the distance O. Also, the connecting wiring electrodes 18 are formed at positions in contact with the wiring electrodes 12 of the recording element substrate 11, when the end face of the recording element substrate on the electrode side is abutted against the end face of driving elements 17*b*, as shown in FIG. 9. That is, two outer driving elements 17*b* are placed in abutment with the recording element substrate 11, whereby the alignment between the recording element substrate and the driving element substrate is made, so that the wiring electrodes of the recording element substrate and the connecting wiring electrodes of the driving element substrate are correctly connected.

Figure 12:
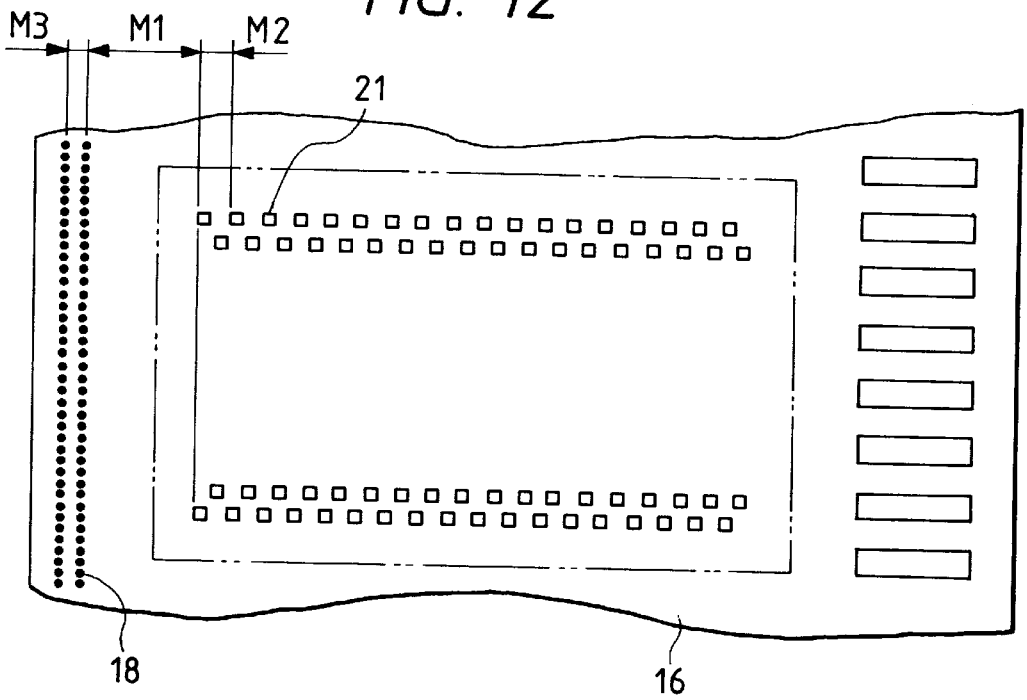
FIG. 12 is an enlarged view of a mounting portion of the driving elements on the driving element substrate as shown in FIG. 11.
Figure 13A:
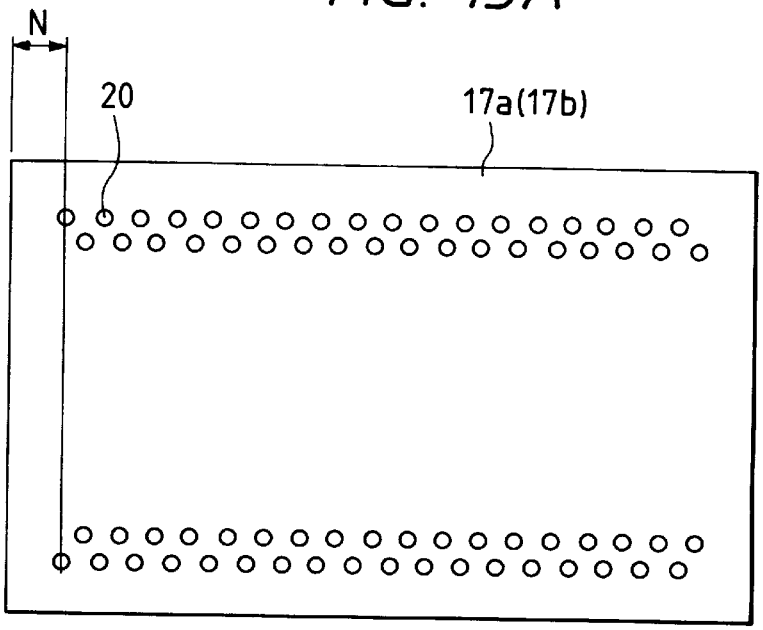
FIGS. 13A and 13B are views illustrating a mounting face and a side face of the driving elements.
Figure 13B:
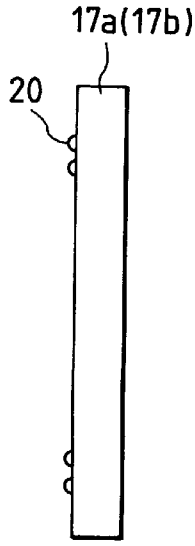

Herein, a construction for mounting the driving elements 17*a*, 17*b* will be described below. FIG. 12 is an enlarged view of a mounting portion of the driving elements in the driving element substrate as shown in FIG. 11, and FIGS. 13A and 13B are views showing a mounting face of the driving elements and a lateral face thereof. While in this example, two driving elements are abutted against the recording element substrate, it should be noted that the number of driving elements to be abutted may be one or more than two. However, to make the positioning easier and securer, two or more is preferable.

As shown in FIGS. 13A and 13B, solder bumps 20 are formed on the mounting face of the driving elements 17*a* (17*b*). The solder bumps 20 are formed such that the pitch is within a precision of about ±10 μm, and the distance N from the solder bumps 20 to the driving elements 17*a* (17*b*) is within a precision of about ±20 μm. On the other hand, the driving element substrate 16 is formed with the driving element connecting pads 21 to which the solder bumps 20 of the driving elements 17*a* (17*b*) are electrically connected, as shown in FIG. 12. The pitch M2 of the driving element connecting pads 21, the distance M1 from the driving element connecting pads 21 to the connecting wiring electrodes 18, and the pitch M3 of the connecting wiring electrodes 18 are within a precision of about ±10 μm, respectively.

And if the driving elements 17*a*, 17*b* are die bonded to the driving element substrate 16, and the solder bumps 20 are molten within a reflow furnace, the mounting of driving elements 17*a*, 17*b* is effected while self-adjusting the position according to a pattern of driving element connecting pads 21, due to surface tension of solder. In this way, the driving element substrate 16 having the above-mentioned dimensional precision and the driving elements 17*a*, 17*b* are flip-chip bonded, such that the position of the driving elements 17*a*, 17*b* with respect to the driving element substrate 16 is within a precision of about ±30 μm.

On the basis of the above constitution, in making the alignment between the recording element substrate 11 and the driving element substrate 16, the end face of the recording element substrate 11 on the side of wiring electrodes 12 and the end face of the driving elements 17 on the side of connecting wiring electrodes 18 are placed into abutment, as shown in FIGS. 9 and 10. Thereby, the alignment of the recording element substrate 11 and the driving element substrate 16 in width direction is made. The alignment between the recording element substrate 11 and the driving element substrate 16 in lengthwise direction can be accomplished by aligning their end faces in lengthwise direction with each other.

As described above, with a quite simple operation of abutting the recording element substrate 11 against the driving elements 17*b*, the recording element substrate 11 and the driving element substrate 16 can be correctly aligned. And there is no need for the special jig or tool for abutment. As the recording element substrate 11 and the driving element substrate 16 are welded after alignment, the wiring electrodes 12 of the recording element substrate 11 and the connecting wiring electrodes 18 of the driving element substrate 16 are securely connected electrically, resulting in a reliable recording head.

Figure 6A:
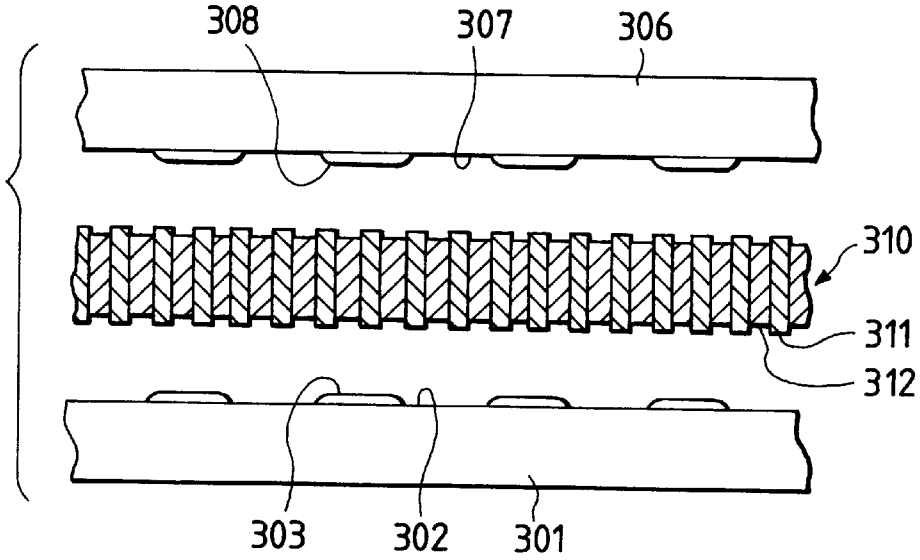
FIGS. 6A and 6B are cross-sectional views of the junction between the recording element substrate and the driving element substrate in a recording element unit as shown in FIG. 5, illustrating the state before joining in FIG. 6A and the state after joining in FIG. 6B.
Figure 6B:
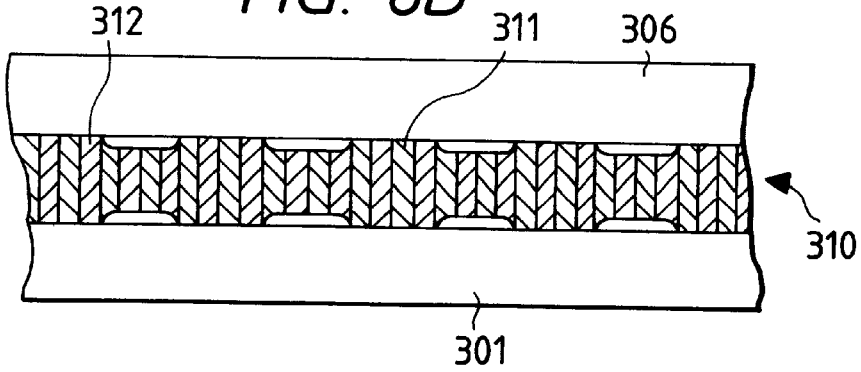
Figure 7:
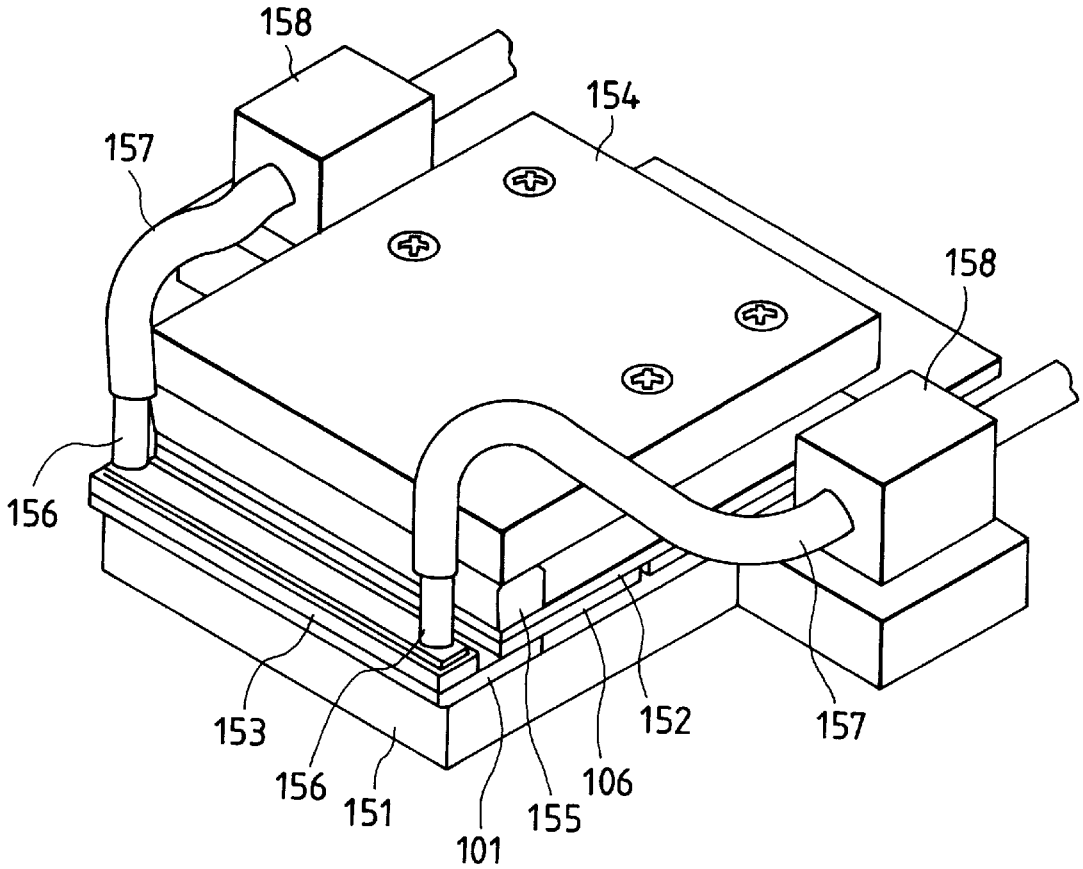
FIG. 7 is a perspective view of the ink-jet recording head using the recording element unit as shown in FIG. 1.

While the wiring electrodes 12 of the recording element substrate 11 and the connecting wiring electrodes 18 of the driving element substrate 16 are directly contacted for electrical connection herein, it should be noted that even when an electrical connecting member is sandwiched between the recording element substrate 11 and the driving element substrate 16, as shown in FIGS. 6A and 6B, the accurate alignment can be similarly accomplished. Also, while the recording element substrate 11 is abutted against two driving elements 17*b* on both sides to make the alignment, it should be noted that three or more driving elements may be used for abutment against the recording element substrate 11.

Figure 16A:
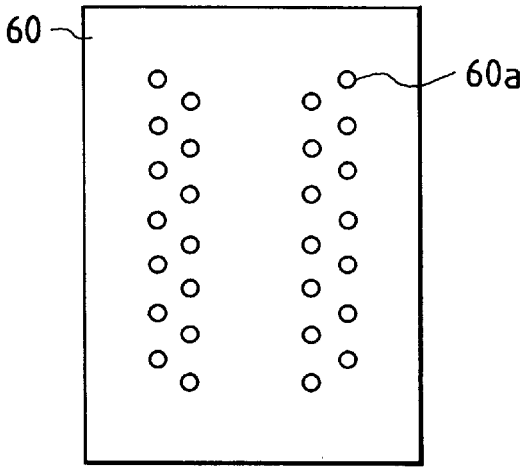
FIGS. 16A and 16B are views of a positioning plate of the driving element substrate as shown in FIG. 15, illustrating a mounting face with its driving element substrate in FIG. 16A, and its lateral face in FIG. 16B.
Figure 16B:
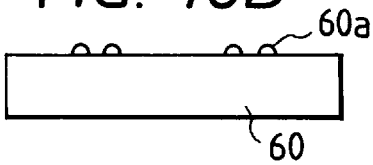
Figure 17:
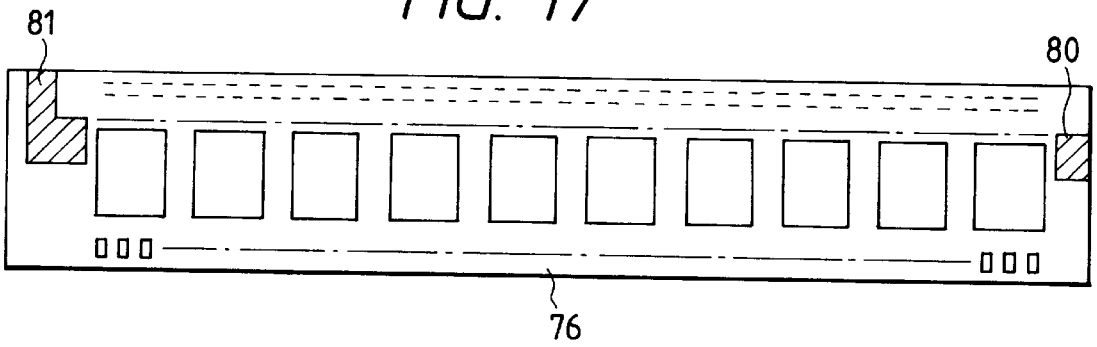
FIG. 17 is a view of the driving element substrate as an application example in the third embodiment of the recording head according to the present invention, as seen from bottom.

Further, in the cases where an ink-jet recording apparatus as shown in FIG. 17 is fabricated using a recording head as above described, if it is necessary to replace a recording element substrate 11 due to any failure in the recording element substrate 11, for example, the recording element substrate 11 can be simply replaced, because the alignment between the recording element substrate 11 and the driving element substrate 16 can be easily made, as above described. Also, the replacement of a driving element substrate 16 can be similarly made in simple manner. The constitution of the ink-jet recording apparatus is the same as the conventional ink-jet recording apparatus as shown in FIGS. 16A and 16B, except for the recording element substrate 11 and the driving element substrate 16, and therefore is not described herein.

(Second embodiment)

Figure 14A:
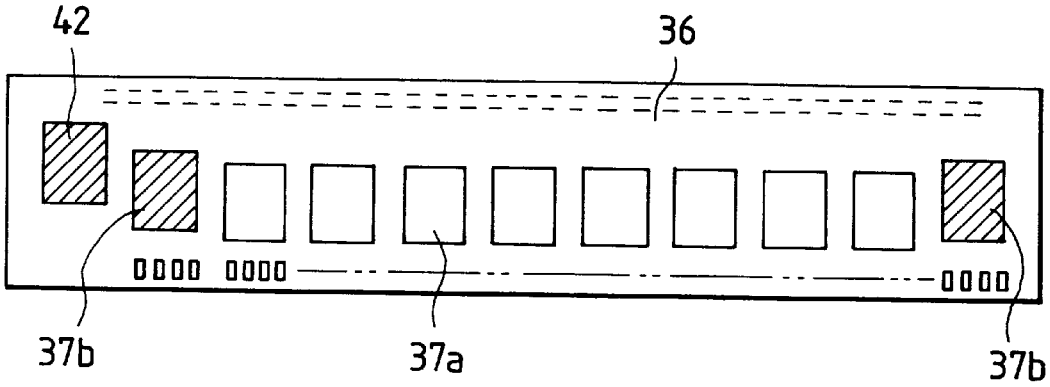
FIGS. 14A and 14B are views of a second embodiment of the recording head according to the present invention, illustrating the driving element substrate as seen from bottom in FIG. 14A, and the recording element substrate and the driving element substrate in the aligned state as seen from bottom in FIG. 14B.
Figure 14B:
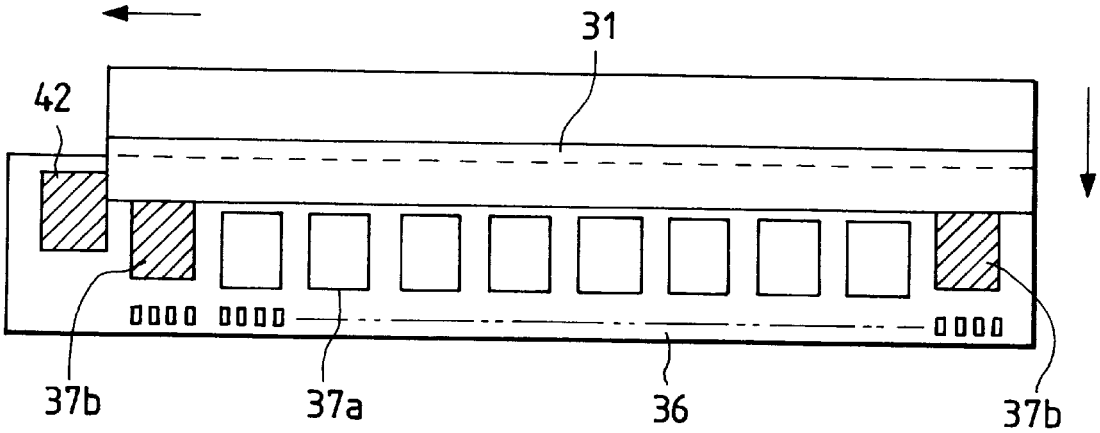

FIGS. 14A and 14B illustrate a second embodiment of a recording head according to the present invention, in which FIG. 14A is a view of a driving element substrate as seen from bottom, and FIG. 14B is a view of a recording element substrate and the driving element substrate which are placed in alignment, as seen from bottom.

This embodiment is different from the first embodiment in that a positioning driving element 42, as well as the driving elements 37*a*, 37*b*, are mounted on the driving element substrate 36. Other constitution of the driving element substrate 36 and the recording element substrate 31 are the same as in the first embodiment, and are not described herein.

The positioning member 42 is not electrically connected to the driving element substrate 36, and an electrically nonconducting driving element is used as the positioning member in this embodiment. And this positioning member is mounted at a position to which the end face of the recording element substrate 31 in lengthwise direction is abutted in the state where the recording element substrate 31 and the driving element substrate 36 are correctly aligned. Also, mounting of the positioning driving element 42 is made by flip-chip bonding. Like other driving elements 37*a*, 37*b*, such that the positional precision of the positioning driving element 42 with respect to the driving element substrate 36 is about ±30 μm, like other driving elements 37*a*, 37*b*.

The alignment between the recording element substrate 31 and the driving element substrate 36 is made by abutting the end face of the recording element substrate 31 in width direction against the driving elements 37*b*, in the same way as in the first embodiment, and the end face of the recording element substrate 31 in lengthwise direction against the positioning driving element 42. Thereby, the alignment between the recording element substrate 31 and the driving element substrate 36 can be effected more simply than in the first embodiment.

This embodiment has the positioning member 42 which is added to the first embodiment. However, since the positioning member 42 does not fulfill any electrical function but simply a structural function for positioning, as above described, any electrical non-conducting member may be used without the need for performing a new process different from the process of providing the driving elements. Therefore, the manufacturing cost will not increase by adding the positioning driving element 42.

(Third embodiment)

While in the above-described embodiment, the alignment between the recording element substrate and the driving element substrate is made by means of the driving elements, it is noted that in this embodiment, a plate-like positioning member, which is different from the driving elements, is provided on the driving element substrate to make the alignment between the recording element substrate and the driving element substrate.

Figure 15:
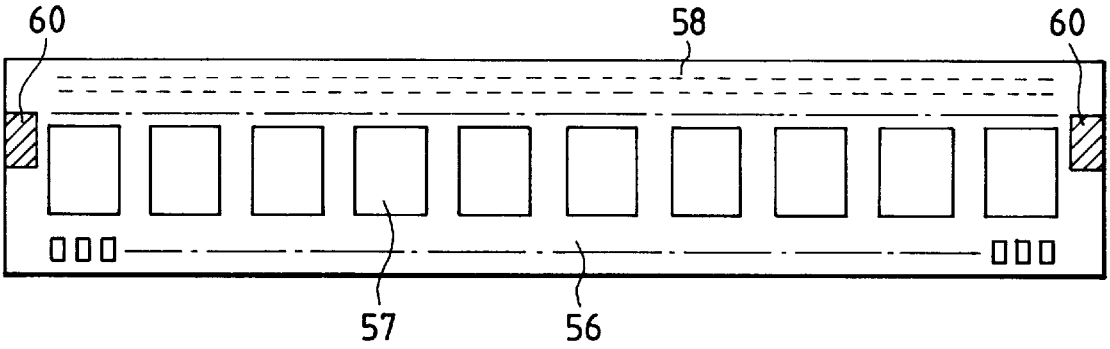
FIG. 15 is a view of a driving element substrate in a third embodiment of the recording head according to the present invention, as seen from bottom.

FIG. 15 is a view of the driving element substrate in a third embodiment of a recording head according to the present invention, as seen from bottom. FIGS. 16A and 16B are views of the positioning member as shown in FIG. 15, in which FIG. 16A is a mounting face with the driving elements thereof, and FIG. 16B is its lateral face.

In FIG. 15, ten driving elements 57 mounted on the driving element substrate 56 are all arranged in the same row. And positioning members 60 are arranged at both ends of the driving element substrate 56 in lengthwise direction, respectively. Other constitution of the driving element substrate 56 and the recording element substrate (not shown) are the same as in the first embodiment, and are not described herein.

The positioning members 60 are made of an insulating material such as Si which is the same material as the packaging material for the driving elements 57, the end face thereof being cut away accurately. Also, solder bumps 60*a* are formed on the back face of the positioning members 60, as shown in FIGS. 16A and 16B, in which the positioning members 60 are mounted on the driving element substrate 56 by flip-chip bonding which is also used in attaching the driving elements on the substrate. Further, the mounting position of the positioning members 60 takes place where the end face of the positioning members 60 on the side of the connecting wiring electrode 58 is abutted against the end face of the recording element substrate, in the state where the recording element substrate and the driving element substrate 56 are accurately aligned.

The alignment between the recording element substrate and the driving element substrate 56 can be made by abutting the end face of the positioning members 60 on the side of the connecting wiring electrode 58 against the end face of the recording element substrate, in the same way as in the first embodiment. Since the positioning members 60, unlike the driving elements 57, can be formed in minimum size as required, there is no need for increasing the size of the driving element substrate 56 specifically. Also, unlike the driving elements 57, the positioning members 60 are not required to make electrical connection with the driving element substrate 56, and thus can be arranged in any form without being affected by the circuit pattern within the driving element substrate 56. Further, by abutting the recording element substrate against the positioning members 60, but not the driving elements 57, there is no risk that any driving elements 57 are damaged, even if an overload is applied at the time of abutting. In particular, since the positioning members 60 are subjected to flip-chip bonding which is also used by attaching the driving elements on the substrate, there is no need for preparing any special process of attaching the positioning members thereon.

In this embodiment, the alignment is made by means of the positioning members as above described, but another application example can be considered as shown in FIG. 17. In FIG. 17, one positioning member 81, among two positioning members 80, 81, mounted on the driving element substrate 76, is formed in L-character shape. The other positioning member 80 is the same as shown in FIG. 15.

Figure 18A:
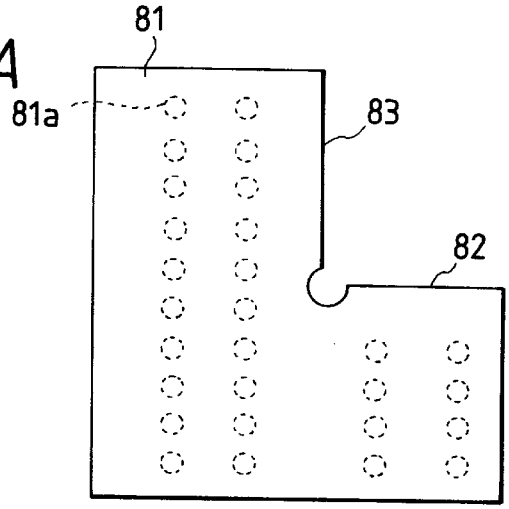
FIGS. 18A and 18B are views of one positioning plate of the driving element substrate as shown in FIG. 17, illustrating its surface in FIG. 18A and its lateral surface in FIG. 18B.
Figure 18B:
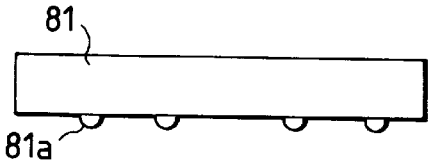

One positioning member 81 is formed, on its back surface, with solder bumps 81*a* as shown in FIGS. 18A and 18B, and mounted on the driving element substrate 76 by flip-chip bonding. Also, this positioning member 81 has a first abutment end face 82 and a second abutment end face 83 which extend orthogonally to each other, and is mounted such that the first abutment end face 82 is abutted against the end face of the recording element substrate in width direction and the second abutment end face 83 is abutted against the end face of the recording element substrate in lengthwise direction in the state where the recording element substrate (not shown) and the driving element substrate 76 are aligned precisely.

The alignment between the recording element substrate and the driving element substrate 76 is accomplished by abutting the end face of the recording element substrate in width direction against the first abutment end face 82 of one positioning plate 81 and the end face of the other positioning plate 80, and the end face of the recording element substrate in lengthwise direction against the second abutment end face 83 of one positioning plate 81. Thereby, the alignment between the recording element substrate and the driving element substrate 76 can be made more easily than in the second embodiment.

A full-line ink-jet head of the present invention and a color ink-jet apparatus with this head will be described below.

Figure 19:
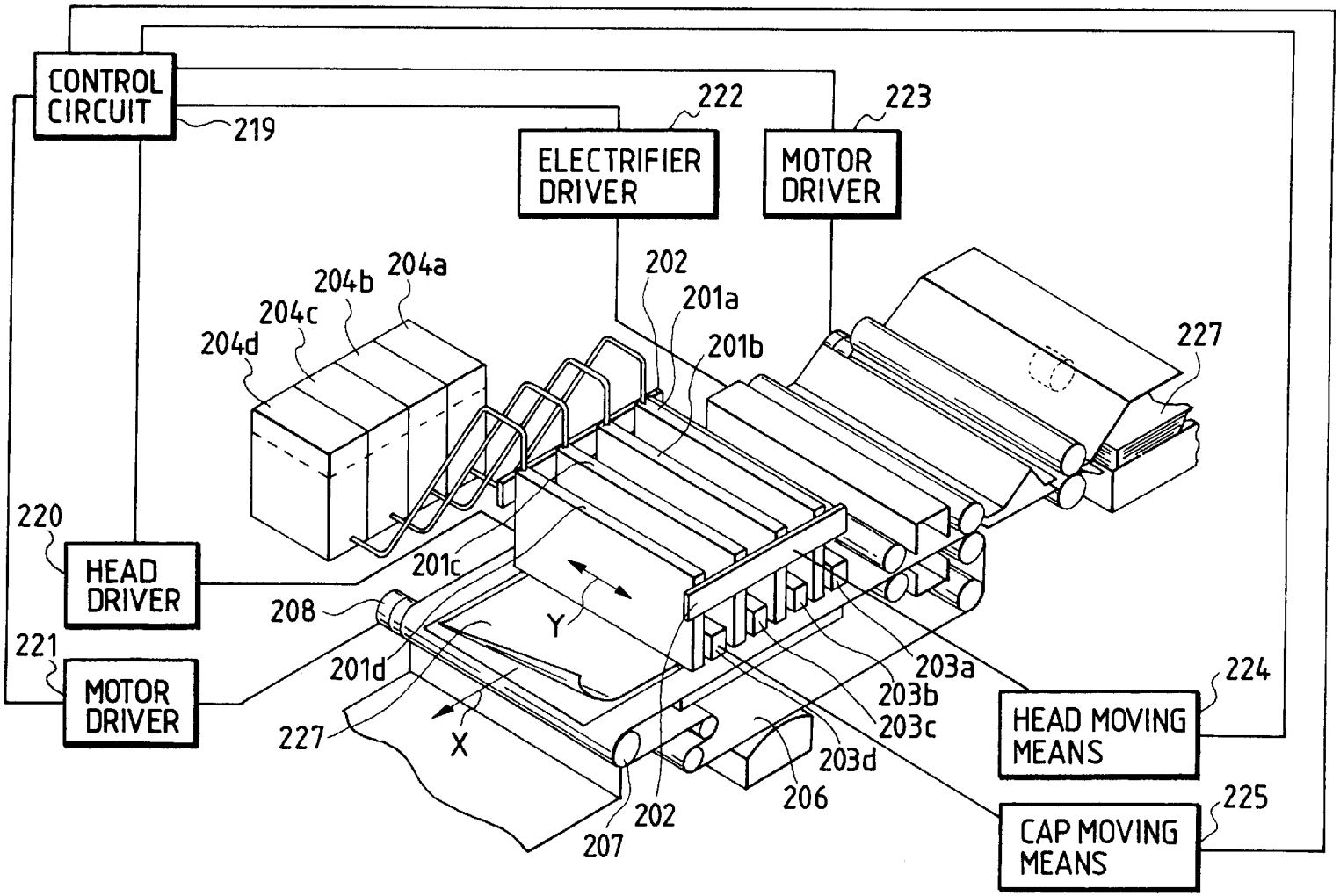
FIG. 19 illustrates an ink-jet recording apparatus using a recording head of the present invention.

FIG. 19 is a view showing one constitutional example of an ink-jet recording apparatus having mounted an ink-jet head in one example which is most representative of the features of the present invention.

The ink-jet recording apparatus comprises the full-line type heads 201*a* to 201*d*, each having a plurality of discharge orifices extending over the length corresponding to the recording width of the recording medium, these full-line type heads being securely supported by a holder 202 in parallel to one another at a predetermined interval in an X direction, as shown in FIG. 19. On a lower surface of each head, 3456 discharge orifices are provided, directed downwardly, at a pitch of 16 discharge orifices/mm in one row along a Y direction, thereby allowing the recording across the width of 218 mm.

Each head is of the type of discharging the recording liquid using heat energy, as described in the previous examples. And it is controlled for discharging by a head driver 220 which is driving signal supply means.

It should be noted that the head unit is constituted including each head and the holder 202, this head unit being movable in the up and down directions by head moving means 224.

Also, the head caps 203*a* to 203*d* corresponding to respective heads are disposed adjacently under the heads. Each head cap has an ink absorbing member such as a sponge inside it.

Also, it should be noted that the caps are fixed within the holder, not shown, and a cap unit is constituted including this holder and the caps, this cap unit being movable in the X direction by cap moving means 225.

Each head is supplied with the inks of colors of cyan, magenta, yellow and black, through the ink supply tubes from the ink tanks 204*a* to 204*d* to effect the color recording.

Also, this ink supply is made owing to capillary phenomenon of the head discharge orifices, in which the liquid level of each ink tank is set a constant distance below the position of discharge orifices.

Also, this apparatus has an electrifiable seamless belt 206 as conveying means for conveying a recording paper or cloth 227 which is the recording medium.

This belt 206 is looped along a predetermined path over a variety of rollers and connected to the driving roller 207, and can be run by a belt driving motor 208 driven by a motor driver 221.

Also, the belt 206 runs in the X directions directly under the discharge orifices for the heads 201*a* to 201*d* while being suppressed therein from downward deflection by a fixing support member 226.

The head driver 220, head moving means 224, cap moving means 225, the motor drivers 221, 223 are all controlled by a control circuit 219.

While in the above-described examples the heating elements for generating the heat by receiving a drive signal to produce bubbles in the ink have been adopted as recording elements, it will be understood that the piezo-electric elements for producing mechanical deformation by receiving a drive signal may be alternatively utilized.

With the present invention as above described, the following effects can be obtained.

With the recording head of the present invention, the alignment can be made easily and correctly only by butting one end face of the recording element substrate against the end face of the driving elements. Further, the cost can be significantly reduced by providing a positioning driving element which is not electrically connected to the driving element substrate. Also, the alignment in two directions can be made, thereby further facilitating the alignment between the recording element substrate and the driving element substrate. In particular, the alignment between the recording element substrate and the driving element substrate can be made at higher precision by mounting the driving elements and the positioning driving element by means of flip-chip bonding. And the head which can be fabricated easily and at lower costs can be obtained without need for the special process owing to provision of the positioning member.

Also, with the provision of the positioning member on the driving element substrate, the alignment can be more easily effected by abutting the end face of the recording element substrate against the end face of the positioning member in the same manner as above described. In this case, the positioning member can be disposed in any manner, because it can be shaped differently from the driving elements and requires no electrical connection to the driving element substrate. And if any overload is applied at the time of abutting, the driving elements can be prevented from being damaged. This positioning member, upon being mounted on the driving element substrate by flip-chip bonding, allows the alignment between the recording element substrate and the driving element substrate to be made more accurately.

The recording apparatus of the present invention comprises the recording head according to the invention, which facilitates the alignment between the recording element substrate and the driving element substrate, such that the recording element substrate or the driving element substrate can be replaced easily.

What is claimed is:

1. A recording head for recording on a recording medium in response to a signal applied to the recording head, comprising:

a recording element substrate provided with a plurality of recording elements for generating energy for recording on the recording medium based on the signal, and a plurality of wiring electrodes electrically connecting to said recording elements respectively; and a driving element substrate different from said recording element substrate provided with a plurality of driving elements for controlling actuation of said recording elements for selectively driving said recording elements, and connecting wiring electrodes for sending said signal output from said driving elements to said wiring electrodes disposed on said recording element substrate, upon being connected to the wiring electrodes of said recording element substrate;

wherein a positioning between said recording element substrate and said driving element substrate is made by abutting said recording element substrate against the end face of said driving elements.

2. A recording head according to claim 1, wherein two or more driving elements in abutment with said recording element substrate are provided.

3. A recording head according to claim 2, wherein two driving elements in abutment with said recording element substrate are provided.

4. A recording head according to claim 1, wherein two driving elements are mounted on said driving element substrate by flip-chip bonding.

5. A recording head comprising:

a recording element substrate provided with a plurality of recording elements for generating energy for recording on a recording medium based on a signal applied to the recording head, and a plurality of wiring electrodes electrically connecting to said recording elements respectively;

a driving element substrate different from said recording element substrate provided with a plurality of driving elements for controlling actuation of said recording elements for selectively driving said recording elements, and connecting wiring electrodes for sending said signal output from said driving elements to said wiring electrodes on said element substrate, upon being connected to wirings of said recording element substrate; and a positioning member, mounted on said driving element substrate by flip-chip bonding, for positioning the junction with said recording element substrate;

wherein the electrical connection between said recording element substrate and said driving element substrate is made in the state where said recording element substrate is abutted against said positioning member.

6. A recording head according to claim 1, wherein said recording element substrate is provided thereon with a plurality of flow passages corresponding to said recording elements, a common liquid chamber for supplying the ink to said plurality of flow passages, and discharge orifices, provided at the end of said flow passages, for discharging the ink.

7. A recording head according to claim 1, wherein said recording elements are heating elements for generating the heat.

8. A recording head according to claim 6, wherein said recording elements are heating elements for generating the heat to produce bubbles in the ink within said flow passages.

9. A recording head according to claim 1, wherein said recording element substrate and said driving element substrate are constructed for separation of said recording element substrate and said driving element substrate.

10. A recording apparatus for performing the recording on a recording medium, comprising:

a recording head having a recording element substrate provided with a plurality of recording elements for generating energy for recording on the recording medium based on a signal applied to the recording head, and a plurality of wiring electrodes electrically connecting to said recording elements respectively, and a driving element substrate different from said recording element substrate provided with a plurality of driving elements for controlling actuation of said recording elements for selectively driving said recording elements, and connecting wiring electrodes for sending said signal output from said driving elements to said wiring electrodes on said recording element substrate, upon being connected to wirings of said recording element substrate, wherein the positioning between said recording element substrate and said driving element substrate is made by abutting said recording element substrate against the end face of said driving elements; and conveying means for conveying the recording medium for recordation by said recording head.

11. A recording apparatus for performing the recording on a recording medium, comprising:

a recording head having a recording element substrate provided with a plurality of recording elements for generating energy for recording on the recording medium based on a signal applied to the recording head, and a plurality of wiring electrodes electrically connecting to said recording elements respectively, a driving element substrate different from said recording element substrate provided with a plurality of driving elements for controlling actuation of said recording elements for selectively driving said recording elements, and connecting wiring electrodes for sending said signal output from said driving elements to said wiring electrodes on said recording element substrate, upon being connected to wirings of said recording element substrate, and a positioning member, mounted on said driving element substrate by flip-chip bonding, for positioning the junction with said recording element substrate, wherein the electrical connection between said recording element substrate and said driving element substrate is made in the state where said recording element substrate is abutted against said positioning member; and conveying means for conveying the recording medium for recordation by said recording head.

12. A recording apparatus according to claim 10, wherein said recording element substrate is provided thereon with flow passages corresponding to said recording elements, a common liquid chamber for supplying the ink to said plurality of flow passages, and discharge orifices, provided at the end of said flow passages, for discharging the ink.

13. A recording apparatus according to claim 10, wherein said recording elements are heating elements for generating the heat.

14. A recording apparatus according to claim 12, wherein said recording elements are heating elements for generating the heat to produce bubbles in the ink within said flow passages.

15. A recording head manufacturing method including the steps of:

providing a recording element substrate provided with a plurality of recording elements for generating energy for recording on a recording medium based on a signal applied to the recording element substrate, and a plurality of wiring electrodes electrically connecting to said recording elements respectively; and providing a plurality of driving elements for controlling actuation of said recording elements for selectively driving said recording elements, and a positioning member for positioning the junction with said recording element substrate, through a flip-chip bonding process, on a driving element substrate different from said recording element substrate and provided with connecting wiring electrodes for sending said signal output from said driving elements to said wiring electrodes on said recording element substrate, upon being connected to wirings of said recording element substrate;

wherein the electrical connection between said recording element substrate and said driving element substrate is made in the state where said recording element substrate is abutted against said positioning member.

16. A recording head according to claim 5, wherein said recording element substrate is provided thereon with a plurality of flow passages corresponding to said recording elements, a common liquid chamber for supplying the ink to said plurality of flow passages, and discharge orifices, provided at the end of said flow passages, for discharging the ink.

17. A recording head according to claim 5, wherein said recording elements are heating elements for generating the heat.

18. A recording head according to claim 5, wherein said recording element substrate and said driving element substrate are constructed for separation of said recording element substrate and said driving element substrate.

19. A recording apparatus according to claim 11, wherein said recording element substrate is provided thereon with flow passages corresponding to said recording elements, a common liquid chamber for supplying the ink to said plurality of flow passages, and discharge orifices, provided at the end of said flow passages, for discharging the ink.

20. A recording apparatus according to claim 11, wherein said recording elements are heating elements for generating the heat.

* * * * *